United States Patent [19]

Willman

[11] 4,296,969

[45] Oct. 27, 1981

[54] THERMAL RECOVERY OF VISCOUS HYDROCARBONS USING ARRAYS OF RADIALLY SPACED HORIZONTAL WELLS

[75] Inventor: Bertram T. Willman, Calgary, Canada

[73] Assignee: Exxon Production Research Company, Houston, Tex.

[21] Appl. No.: 139,618

[22] Filed: Apr. 11, 1980

[51] Int. Cl.[3] ..... E21C 41/10

[52] U.S. Cl. ..... 299/2; 166/50; 166/272

[58] Field of Search ..... 299/2, 4; 166/272, 50

[56] References Cited

U.S. PATENT DOCUMENTS 4,020,901 5/1977 Pisio et al. ..... 166/50

4,160,481 7/1979 Turk et al. ..... 299/2

*Primary Examiner*—Ernest R. Purser

*Attorney, Agent, or Firm*—Michael A. Nametz

[57] ABSTRACT

Normally immobile mineral values are recovered from a subterranean formation by penetrating the formation with an access shaft and drilling two radial arrays of substantially horizontal wells out into the formation from the shaft, one array of wells being substantially shorter than the other array. A mobilizing fluid is injected into the formation via alternate longer wells so that an outer zone of high fluid mobility is created in the formation. Then the mobilizing fluid is injected into all of the longer wells to sweep the mineral values to the shorter wells where such values are recovered. Improved sweep efficiency of the mineral values is achieved thereby.

21 Claims, 6 Drawing Figures

2A

2B

2C 2D
(OPTIONAL)

THERMAL RECOVERY OF VISCOUS HYDROCARBONS USING ARRAYS OF RADIALLY SPACED HORIZONTAL WELLS

BACKGROUND OF THE INVENTION

1. Field of the Invention

This invention relates to a process and apparatus for extracting mineral values from the earth. More specifically, this invention relates to a method and well system for recovering viscous hydrocarbons such as bitumen from a subterranean reservoir by injecting a heated fluid into the reservoir via an array of radially spaced horizontal wells.

2. Description of the Prior Art

In many areas of the world, there are large deposits of viscous petroleum, such as the Athabasca and Cold Lake Regions in Alberta, the Jobo Region in Venezuela and the Edna and Sisquoc Regions in California. These deposits are often referred to as "tar sand" or "heavy oil" deposits due to the high viscosity of the hydrocarbons which they contain. The distinction between tar sands and heavy oil is not settled. For both, however, normal reservoir flow rates are low, and techniques to improve flow are generally applicable to either without substantial changes including the present invention. Tar sand formations may extend for many miles and occur in varying thicknesses of up to more than 300 feet. These deposits may lie at or near the earth's surface or may be located under an overburden thousands of feet thick. However, tar sands not directly accessible from the surface consititute some of the world's largest presently known petroleum deposits. The tar sands contain a viscous hydrocarbon material, commonly referred to as bitumen, in an amount which ranges up to about 20% by weight. Bitumen is normally immobile at typical reservoir temperatures. For example, in the Cold Lake Region of Alberta, at a typical reservoir temperature of about 55° F., bitumen or heavy oil is immobile with a viscosity of about one thousand poise. However, at higher temperatures such as temperatures exceeding 200° F., the bitumen generally becomes mobile with a viscosity of less than 200 centipoise.

Since most heavy oil deposits are too deep to be mined economically, various in situ recovery processes have been proposed for separating the viscous oil from the sand in the formation itself and producing the oil through a well drilled into the deposit. Among the various methods for in situ recovery of bitumen from tar sands, processes which involve the injection of steam are generally regarded as the most economical and efficient. Steam can be utilized to heat and fluidize the immobile bitumen and, in some cases, to drive the immobilized bitumen toward production means.

The most common and proven method for recovering viscous hydrocarbons is by using steam stimulation techniques, an example being the "huff and puff" process. In this type of process, steam is injected into a formation by means of a well (the well is then sometimes shut-in to permit the steam to heat the bitumen), thereby reducing the viscosity of the crude oil. Subsequently, all formation fluids, including bitumen of reduced viscosity, water and steam, are produced from the same well using accumulated reservoir pressure as the driving force for production. Initially, sufficient pressure may be available in the vicinity of the wellbore to lift fluids to the surface; as the pressure falls, artificial lifting methods are normally employed. Production is terminated when the rate of oil production declines to an uneconomic rate. The cycle is then repeated until overall cycle economics are no longer attractive.

During the early cycles of steam injection and fluid production, oil production rates may be quite high since the oil nearest to the well is being produced. However, during subsequent steam cycles as the oil nearest the well is depleted, steam must move farther into the formation to contact the oil and as a result increased heat losses make the steam less effective as an oil recovery agent. The process looses efficiency with each cycle and eventually oil production becomes uneconomical.

Another general method for recovering viscous hydrocarbons is by using "thermal drive" processes. Such processes employ at least two wells, an injection well and a production well, spaced apart from each other by some distance and extending into the heavy oil formation. In operation, a heated fluid, usually steam or hot water, or a heat-generating fluid such as air, is injected through the injection well into the formation where it heats and drives fluids towards the production well. The dominant mechanisms for oil displacement are viscosity reduction of oil (as with steam stimulation), swelling and perhaps steam distillation, depending on the character of the oil. The principal advantage of using a thermal drive process is that higher overall recoveries can usually be obtained than with steam stimulation processes. For example, it has been the general experience in California that only relatively low recoveries are obtained overall by steam stimulation; on the other hand, while the recovery is higher with steam floods, more heat is used per barrel of oil produced.

One basic problem with thermal drive is that while the region of the reservoir which has been swept by the heated fluid or heat-generating fluid contains low residual oil saturations, generally less than half of the reservoir is swept before the flowing heated or heat-generating fluid breaks through at the production well. Once this occurs, fluid bypass tends to make further operations uneconomical. A great deal of work in the industry has been devoted to improving the fraction of the reservoir volume which can be swept by the thermal process before the heated or heat-generating fluid breaks through at the production well causing oil production to become uneconomic, i.e., improved sweep efficiencies are needed.

Many of the more promising approaches currently being developed utilize combinations of horizontal wells in order to improve oil recoveries. Such horizontal wells may also be combined with access shafts or very large-diameter boreholes capable of accommodating the passage of men and equipment.

One such process is described in U.S. Pat. No. 4,020,901 which issued on May 3, 1977 to Peter Pisio and Charles F. Kirkvolt (Chevron Research Company). This patent discloses a special arrangement of equipment for recovering heavy oil from very thick tar sand formations. The invention involves the use of heating conduits extending horizontally from a vertical shaft into the tar sand formation. Steam is flowed through the horizontal conduits to indirectly heat the adjacent formation and create a flowpath surrounding the conduits for production of fluids. In order to promote flow of heated petroleum to the flowpath, steam is injected directly into the formation via separate injection conduits. The patent discloses the use of a set of vertical injection conduits for delivering steam to the formation;

alternatively, a set of slanted wells may be used to deliver the steam to the formation. In essence, the approach taken is to sweep the heated petroleum into a laterally extending flowpath and outwardly along the flowpath. The heated petroleum is then recovered near the end of the horizontal conduit and floats into the shaft. Presumably, over time, the steam will sweep more and more petroleum to the end of the horizontal conduit thereby creating an expanding steam saturated region.

One problem with the method of U.S. Pat. No. 4,020,901 is that while the creation of a flowpath is highly desirable, the approach here will be inherently extremely slow since heat is delivered to the formation for this purpose only indirectly. Conductive heating by indirect heating of the formation adjacent the horizontal conduit will be slow. Also, the method does not utilize many of the advantages of steam stimulation, such as removal of near-wellbore damage caused by fine solids, and asphaltic paraffinic deposits. In addition, a hot path between the injection location and production location is needed to effect fluid communication; however, this hot path of very high mobility tends to cause hot injected fluid to bypass the cold, viscous oil which must be heated.

Another patent utilizing a mine shaft or other large-diameter access shaft is U.S. Pat. No. 4,160,481 which issued on July 10, 1979 to L. J. Turk and R. O. Kehle (assignee: the HOP Corporation). Some popular accounts of this method have referred to it as the "hot-plate" process. This is because steam is injected into the formation via horizontal wells which extend from a central access shaft like spokes on a wheel. The steam penetrates into the formation upwardly due to gravity and heat is transferred to the viscous oil. Once heated, the oil begins to flow. Oil and water are produced back through the horizontal wells and pumped through the vertical access shaft for treatment. The patent also discloses that oil may be more effectively swept from the formation by simultaneously injecting steam via one or more of the horizontal wells and producing oil via one or more other horizontal wells. However, the technique is primarily a steam stimulation or steam soak technique.

While U.S. Pat. No. 4,160,481 represents an advancement in systematically heating a formation and recovering normally immobile heavy oil in an efficient manner, problems still exist in the sweep efficiency of the process. It is believed that substantial quantities of oil will remain between the radially extending horizontal wells. Therefore, there is a continuing need for an improved thermal process for the effective recovery of viscous hydrocarbons from subterranean formations such as tar sand deposits, especially a process having improved sweep efficiency.

SUMMARY OF THE INVENTION

In accordance with the present invention, an in-situ process and well geometry are provided for recovering normally immobile mineral values from a subterranean formation. An access shaft is formed in the formation and a first array of radially-spaced horizontal wells is drilled from the shaft into the formation. The first array of wells is completed so that upon the injection, via alternate wells, of a mobilizing fluid capable of causing the mineral values to flow, an outer zone of high fluid mobility is formed between the ends of the first array of wells. Then, a second array of horizontal wells is drilled, radially spaced between the first array and being substantially shorter than the first array. The mobilizing fluid is then injected into the formation via said first array of wells to mobilize and drive mineral values to the second array of wells, where such values can be recovered. By creating the outer ring of high fluid mobility and using the short horizontal wells, vastly improved sweep efficiencies are achieved.

The preferred embodiment is an improved in-situ thermal method and well geometry for recovering heavy oil or bitumen. The invention is a significant improvement over the process described in U.S. Pat. No. 4,160,481. The preferred embodiment comprises the following steps: (1) forming a large diameter access shaft in a subterranean bitumenous formation; (2) drilling a first set of radially-spaced, substantially horizontal wells out from the access shaft; (3) completing each horizontal well over most of its length such that fluid communication exists with the formation; (4) injecting a heated or heat-generating fluid into the first set of wells and into the formation, and allowing the formation to soak; (5) producing oil from te first set of horizontal wells until production is no longer efficient; (6) repeating the fluid injection, soak and production cycle until oil production is no longer efficient; (7) cementing a liner in or otherwise plugging each horizontal well over a majority of its length to prevent fluid communication with the formation over the plugged portion, while leaving an end portion of each well in fluid communication with the formation; (8) injecting heated or heat-generating fluid into alternate wells of the first set of wells to displace oil to the remaining horizontal wells to create a path of thermal communication between the ends of the first set of wells (a heated annular zone of high fluid mobility); (9) drilling a second set of horizontal wells which are radially spaced between the first set and which are substantially shorter than the first set of wells; (10) injecting the heated or heat-generating fluid into the first set of wells to displace and force hydrocarbons to the second set of short horizontal wells, and producing oil from the second set of wells. Vastly improved sweep efficiency and oil recoveries can be achieved using this invention.

The "soak" period mentioned in steps (4) and (6) may be as short as the time it takes to turn the wells around following injection of heated or heat-generating fluid (i.e. without shutting in), or the wells may be physically shut-in depending on the type of oil and reservoir characteristics. In addition, it will be preferred for very viscous oils (e.g., Cold Lake, Alberta) to inject steam during the stimulation steps (4) and (6) at above formation fracture pressures. Then during the thermal drive stage steps (8) and (10), steam will preferably be injected at below fracture pressure.

DETAILED DESCRIPTION OF THE INVENTION

The present invention is a thermal recovery process utilizing a special well geometry to provide significantly improved sweep efficiencies over the well geometry and process of U.S. Pat. No. 4,160,481. The invention is preferably applied in recovering normally immobile carbonaceous material from a subterranean formation by heating it with a heated or heat-generating fluid, although other applications where improved sweep efficiency is a requirement will be apparent to those skilled in the art. Such applications would include the leaching of uranium or other minerals in situ. The preferred method involves the steam stimulation of a reservoir utilizing a set of radially spaced long horizontal wells, completing this set of wells so that subsequent steam flooding can be performed to create an outer annular thermal communication zone surrounding the radially-spaced long horizontal wells, drilling another set of short horizontal wells in between the initially drilled wells, and injecting steam into the formation so that oil is swept to the short wells. Preferably, both sets of horizontal wells are completed so that the reservoir volume adjacent to the accesss shaft remains cool. Optionally, the short wells may be ultimately recompleted so as to sweep oil from the reservoir region immediately adjacent to the access shaft. By practicing this invention, substantial additional quantities of oil are swept from the reservoir.

The following description will disclose an especially preferred embodiment, involving the use of steam to heat and mobilize viscous crude. However, it should be understood that the method and geometry of the present invention should not be so limited and includes the use of other heated fluids (eg. hot water, solvent vapors, etc.) or heat-generating fluids (eg. air) which can be employed to reduce the viscosity of the heavy oil. It will be apparent to those skilled in the art which fluids will be most appropriate; this selection will depend in particular upon the reservoir characteristics, crude oil characteristics, availability of the particular fluid, and so forth. It can be noted with respect to the use of a heat-generating fluid, however, that the complete combustion of oil in the area covered by the horizontal wells is not necessary. Rather, only such amounts of the heat-generating fluid as are necessary to cause the viscous crude oil to flow will usually be injected.

Figure 1A:
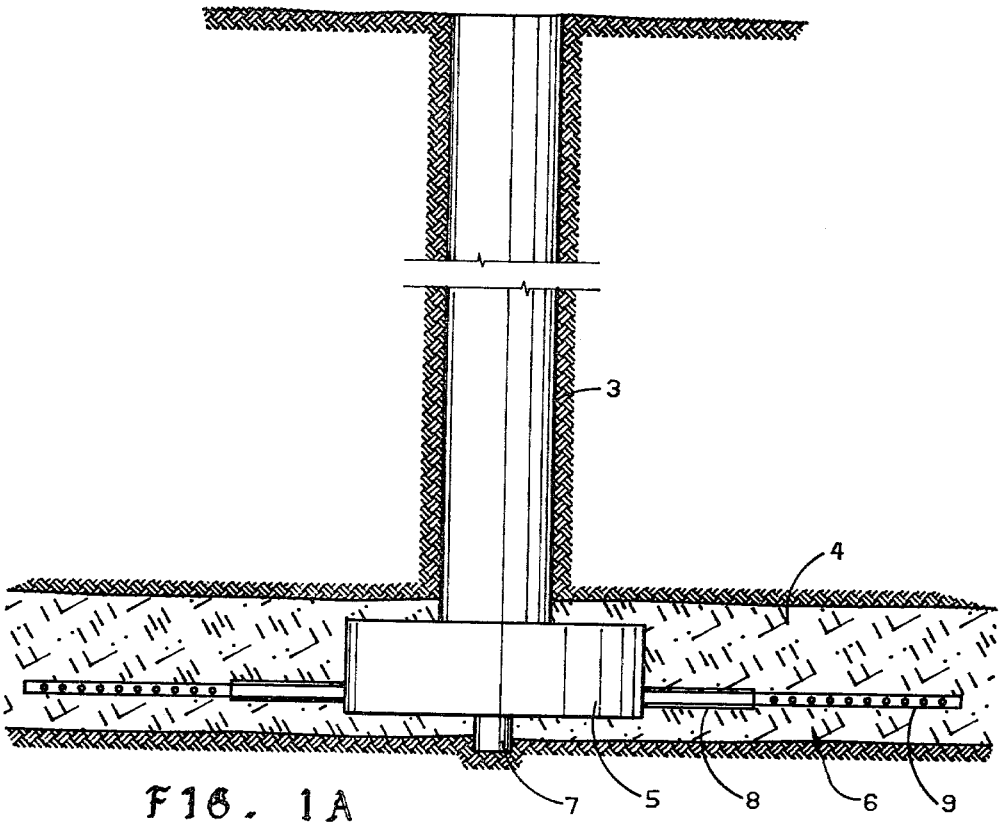
FIGS. 1(*a*) and 1(*b*) taken together schematically illustrate a well array for practicing the method of U.S. Pat. No. 4,160,481.
Figure 1B:
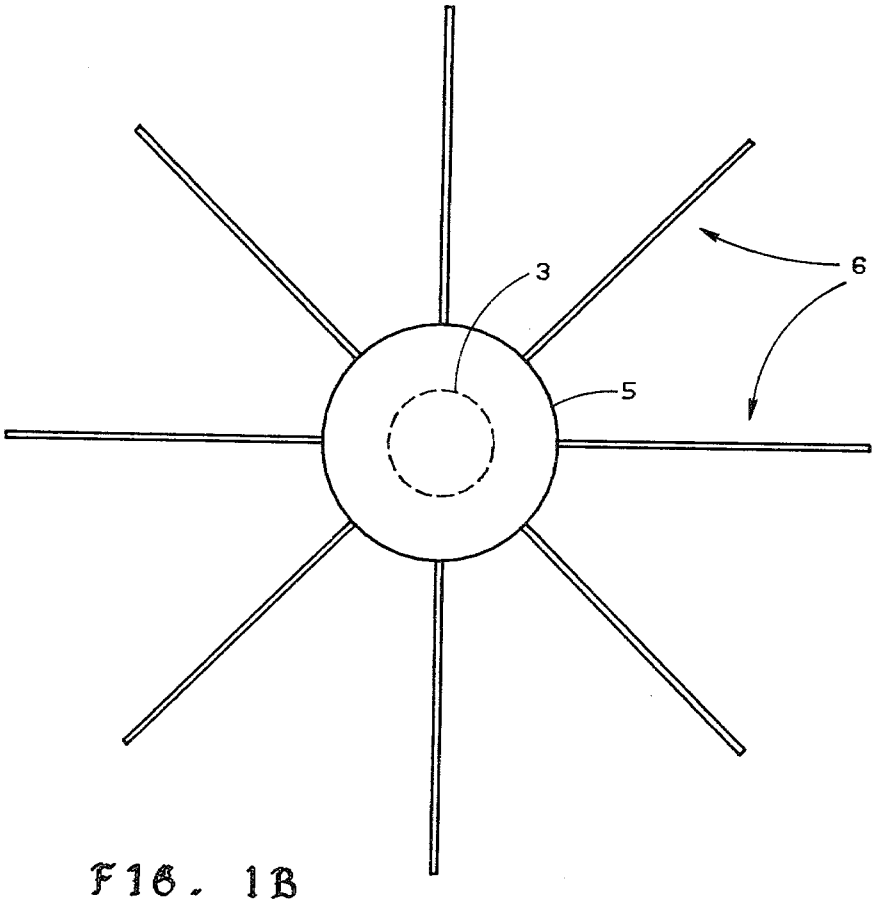

As mentioned, this invention is a significant improvement over the method of U.S. Pat. No. 4,160,481. The method of this patent may be better understood by referring to FIGS. 1(*a*) and 1(*b*). A substantially large diameter vertical access shaft 3 penetrates subterranean heavy oil formation 4. The access shaft 3 is provided with a larger work chamber 5 at its lower end and also a sump hole 7 beneath the chamber 5. The access shaft 3 and work chamber 5 are sized and provided with appropriate equipment so that workmen are able to descend therein to perform necessary tasks. A plurality of horizontal wells 6 are then drilled into the formation 4. These wells are radially spaced from each other, as particularly illustrated schematically by FIG. 1(*b*). A relatively short portion of each well 6 will be provided with casing 8 while the remaining portion of each well 6 will be lined with a perforated drain pipe or screened liner 9. Typical lengths of the wells 6 will range from approximately 500 to 2000 feet long. Steam is injected into the formation via the wells 6 and allowed to heat the oil. Heated fluids, including crude oil, are recovered via the wells 6. This steam stimulation cycle is repeated until oil production declines to uneconomic levels.

According to the method of U.S. Pat. No. 4,160,481, the radial wells may be used in a thermal drive or steam flooding mode, without modifying the wells or manner of injection in any manner. Unfortunately, while improved oil recoveries are possible, sweep efficiencies will still not be satisfactory. For example, it is predicted that only from about 10% to about 50% of the potential oil recovery will be achieved in the region containing the radial wells 6 due to poor sweep. Much of the remaining oil lies in-between the radial wells 6.

The present invention involves a unique combination of proper completion techniques, improved flooding with a heated or heat-generating fluid and the drilling of additional short wells in order to significantly improve sweep and recovery efficiency. In addition, the method provides for safe operating conditions for the workmen located in the cavern 5.

Figure 2:
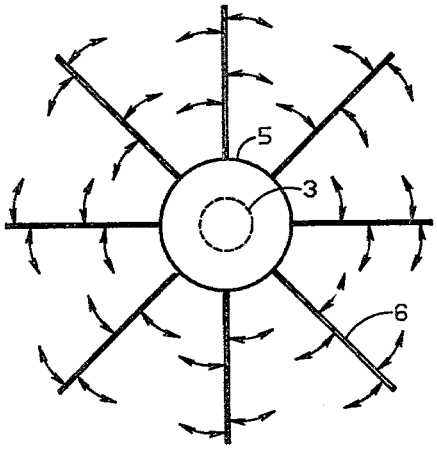
FIGS. 2(*a*) through 2(*d*) taken together schematically illustrate the method of the present invention.
Figure 2:
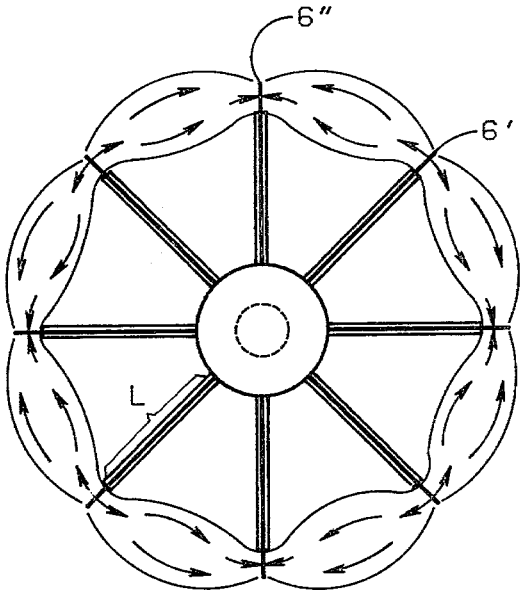
Figure 2:
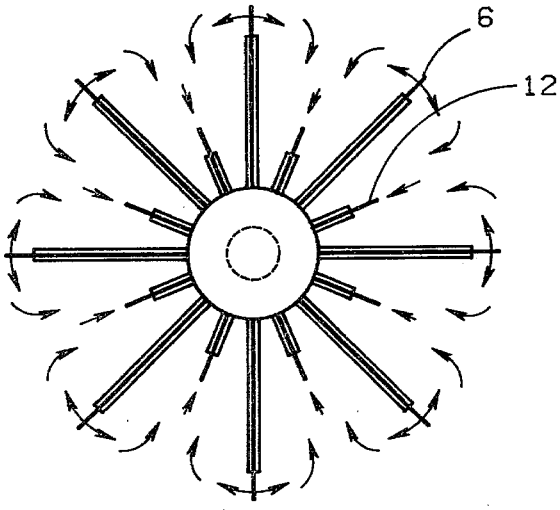
Figure 2:
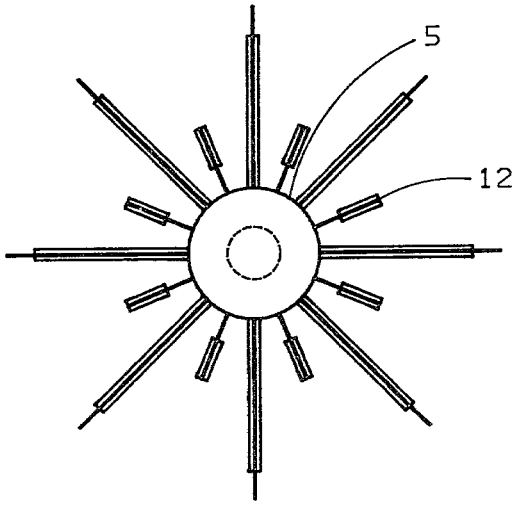

FIG. 2 illustrates the sequence of steps in achieving these benefits. Again, the following description will focus on the recovery of heavy oil using steam as a heated fluid, but the invention is not limited to the use of steam (or heavy oil for that matter). The method of U.S. Pat. No. 4,160,481 is initially applied and is represented by FIG. 2(*a*). The double arrows indicate that steam is initially injected and mobilized fluids produced through all radial wells 6; that is, a steam stimulation process is applied. Wells 6 are conventionally completed, being in fluid communication with the formation over most of their length. For example, a liner slotted over most of its length may be installed in each well using well-known techniques.

It should be noted that, for heavy oil or tar sand formations, it is especially preferred to inject steam at above formation fracture pressures during the stimulation process. For example, it has been discovered that in certain formations, unless steam is injected at above fracture pressure, the stimulation process is too slow to be considered economic at current world oil prices.

After a number of steam stimulation cycles, frequently 5 to 10, oil production per barrel of steam will decline and the oil/steam ratio for the last cycle will become relatively unattractive economically. To obtain the remaining recoverable oil, which may be as high as 50 to 90 percent of that originally present in the region of the deposit containing the horizontal wells 6, a steam flooding displacement must be performed. However, because of steam bypass it will not be possible to simply utilize the well configuration of FIGS. 1(*a*) and (*b*) wherein the steam is introduced over substantially the entire length of each well 6. The geometry of the system shown in FIGS. 1(*a*) and (*b*) in such that steam will flow into and oil will be displaced from only a narrow path between the perforations immediately next to the end of adjacent casings 8. The bulk of the oil remaining between adjacent wells 6 following steam stimulation will therefore not be recovered by steam drive due to the steam short circuit.

In practicing this invention in heavy oil or tar sand formations, above fracture steam stimulation is continued until a minimum degree of oil mobility is created in the formation. In other words, the formation will be heated sufficiently so that a steam displacement process can be performed at a reasonable rate below fracture pressure. Then, with reference to FIG. 2(*b*) in particular, each radial well 6 is recompleted so as to prevent fluid communication with the deposit 4 over a majority of its length, and preferably over about 60 to about 95 percent of its length (i.e., 5–40% will communicate with the formation). This may involve squeezing cement into the liner or casing openings, or otherwise plugging some of the openings. The double-lined portions of each well in FIGS. 2(*a*)–2(*d*), for example length "L" of FIG. 2(*b*), represent the portion of each well which has been prevented from communicating with the formation. Alternate horizontal wells 6 are then utilized as injection wells and production wells, as represented schematically by FIG. 2(*b*). Steam at below formation fracturing pressure is then injected into the injection wells 6' to displace fluids (both oil and water), which are produced from the production wells 6''. Steam injection and fluid production are continued until thermal communication is established between alternate wells, i.e. a path of high fluid mobility is eastablished between the ends of the injection wells 6' and production wells 6''. As may be seen in FIG. 2(*b*), an outer heated zone of high oil mobility is created in the deposit 4. The creation of this high mobility zone is one critical feature of this invention. This permits later operation without substantial steam bypass and results in significantly improved sweep efficiencies.

The next step in practicing this invention is to drill a second set of nearly horizontal wells 12 between the original set. These wells must be substantially shorter than the initial set of wells, preferably as short as possible. Thus, if wells 6 were approximately 500–2000 feet long, the short wells 12 might be drilled out to a distance of from about 35 feet to about 200 feet. These short wells 12 are completed, as with wells 6, such that the portions of the short wells 12 adjacent to the cavern 5 are not permitted to fluidly communicate with the deposit 4. The length which is in fluid communication (eg. perforated section of a casing) is determined so as to provide a reasonable production rate, while the unperforated section will have a length consistent with a comfortable working environment in the cavern 5. For example, good working numbers for many formations for the unperforated length would be about 25–50 feet, with 10–150 foot perforated outer portion. Note that while reference is made to a perforated portion, this should not be construed as limiting; a screened or slotted liner may be used over this length, or other manner of creating fluid communication between a portion of the well and the formation. The length of the perforated portion will be determined by the desired production rate and will be consistent with avoiding excessive rates of sand production. That is, a long enough perforated length will be used to handle the anticipated flow rate, but no longer than necessary for this purpose. It should also be noted that the short wells 12 may be drilled and completed at the same time as wells 6, so long as they are prevented from communicating with the formation until the thermal drive step is ready to be accomplished. This may be done, for example, by casing the short wells, but not perforating the wells.

The original horizontal wells 6 are then converted to injection wells. Steam is injected through all original wells 6 at below fracture pressures and reservoir fluids are displaced toward the new short wells 12. This is schematically illustrated by FIG. 2(*c*).

With reference to FIG. 2(*d*), a final optional procedure will be preferred when significant quantities of oil remain adjacent to the cavern 5. The outer portion of each short production well 12 in communication with the deposit is plugged with suitable material, such as cement, and the portion of each well 12 which is adjacent to the cavity is recompleted so as to be in fluid communication with the deposit. Again, this may involve perforating this portion, or otherwise forming an opening in the casing or liner of wells 12. Residual steam pressure in the formation will then further displace oil into wells 12 for recovery.

A major purpose of leaving an unperforated zone in the short wells adjacent to the cavern 5 until just before abandonment is to provide an insulating volume in the formation surrounding the cavern 5 as a heat shield. The size of the desirable heat shield will depend on formation temperature, steam temperature, allowable cavity temperature, cavity cooling installed, and the time of operation. Generally from about 25 to about 100 feet will be suitable depending also of course on the total length of the short well.

Further details on drilling and completing horizontal wells may be found in G. E. Bezaire and I. A. Markiw, "Esso Resources Horizontal Hole Project at Cold Lake", Paper No. 79–3010, presented at the 30th Annual Technical Meeting of the Petroleum Society of CIM, May 8–11, 1979.

Finally, it may be noted that the precise quantities of steam (or other heated or heat-generating fluid) to be injected cannot be determined without knowing details of a particular reservoir; however, one skilled in the art can easily determine these quantities. For the preferred process utilizing steam, for example, the stimulation steps may utilize a total volume per well of from perhaps 20,000 to 400,000 bbls of steam having a 50%–100% quality at 150 to 2000 psi. When injecting steam at above fracture pressures, as is especially preferred for many heavy oil or tar sand reservoirs, the primary reservoir characteristic determining steam quantities will be the reservoir thickness. The steam drive steps may use a similar quality steam at below fracture pressures in amounts ranging from perhaps 0.5 to 1.5 pore volumes of the reservoir volume to be swept. These specific numbers are not intended to be limiting, however, but illustrative.

It should also be apparent to those skilled in the art that generally the horizontal wells will be located near the bottom of a given reservoir; however, this will of course depend on vertical permeabilities and the presence of horizontal low permeability regions, etc. Further, the expression "horizontal wells" will include wells having a slightly downward or upward slope in order to facilitate production of fluids.

While the foregoing discussion has been devoted to a description of a well geometry utilizing a 360° radial array of horizontal wells whose ends roughly define a circle, it should be apparent that the invention could be practiced with fewer wells whose ends need not define a circle. Such an arrangement might be appropriate, for example, for an access shaft located near the outer boundary of a given formation. This arrangement could consist of two long radially-spaced horizontal wells in combination with a single short horizontal well in between. A mobilizing fluid is injected into one long well to create a path of high fluid mobility between the ends thereof. Then, the mobilizing fluid is injected into both long wells to mobilize and drive mineral values located between the two long wells to the short well for recovery. Note that the two long wells and the short well will be geometrically arranged to provide a sufficient distance between the end of the short well and the high mobility path so that the mobilizing fluid can sweep a substantial portion of the mineral values located between the long wells before breaking through to the short well, i.e., to give good sweep efficiency. This distance is inherently sufficient with a radial array of wells as shown in FIG. 2. For most applications, a greater number of wells will be preferred in order to achieve the best sweep efficiency and good economics.

In consequence of practicing this invention, significantly higher displacement and oil recovery efficiencies are obtained. The cavity or cavern 5 is shielded to a maximum extent from the high injection pressures desirable during the steam flooding of the deposit 4. The method of this invention provides a significant improvement over the process of U.S. Pat. No. 4,160,481.

Various modifications and alterations in the practice of this invention and in particular in the heated or heat-generating fluid to be used should be apparent to those skilled in the art without departing from the scope and spirit of this invention. It should be understood that the invention claimed here should be unduly limited to the specific example or embodiment set forth herein.

Having described my invention in detail, what I claim is:

1. A method for recovering normally immobile mineral values from a subterranean formation, the method comprising:

(a) penetrating said formation with an access shaft;

(b) extending first and second radially-spaced substantially horizontal wells from said shaft into said formation;

(c) extending a third substantially horizontal well from said shaft into said formation, said third well being located between said first and second wells and being substantially shorter than either of said first and second wells;

(d) injecting a mobilizing fluid into said first well and recovering mobilized mineral values via said second well so that a path of high fluid mobility is created in said formation between the ends of said first and second wells;

(e) injecting said mobilizing fluid into said first and second wells to further mobilize and drive mineral values through said formation to said third well, the end of said third well being located a sufficient distance from said high mobility path to provide for good sweep efficiency of the mineral values located between said first and second wells; and (f) recovering said mobilized mineral values via said third well.

2. The process of claim 1 wherein said mineral values are heavy oil or bitumen.

3. The process of claim 2 wherein said mobilizing fluid is a heated or heat-generating fluid.

4. The process of claim 2 wherein said mobilizing fluid is steam.

5. The process of claim 2 wherein said mobilizing fluid is an oxygen-containing gas.

6. A process for recovering normally immobile mineral values from a subterranean formation, the process which comprises the steps of:

(a) sinking an access shaft into said formation;

(b) penetrating said formation from said shaft with a first array of radially-spaced horizontal wells, the outer ends of these wells defining an annular zone around said shaft;

(c) completing said first array of wells so that the outer ends of these wells are in fluid communication with said formation;

(d) injecting a mobilizing fluid through alternate wells of said first array, until a high fluid mobility is created in said annular zone;

(e) penetrating said formation with a second array of horizontal wells, radially-spaced between said first array of wells, said second array of wells being substantially shorter than said first array of wells;

(f) injecting said mobilizing fluid into said formation via said first array of wells to drive mobilized mineral values to said second array of wells; and (g) recovering said mobilized mineral values via said second array of wells.

7. The process of claim 6 wherein each of said first array of wells ranges from about 500 to about 2000 feet long and each of said second array of wells ranges from about 35 feet to about 200 feet long.

8. A thermal process for recovering normally immobile carbonaceous materials from a subterranean formation which comprises:

(a) penetrating said formation with a generally vertical access shaft having a work chamber at its lower end;

(b) extending a first plurality of wells laterally and radially outward from said chamber into said formation;

(c) injecting a heated or heat-generating fluid into said formation via said first plurality of wells to heat and fluidize a portion of said carbonaceous materials:

(d) producing said fluidized carbonaceous materials via said first plurality of wells;

(e) completing each of said first plurality of wells so as to be in fluid communication with said formation over only an outer portion thereof;

(f) injecting said heated or heat-generating fluid into and recovering fluidized carbon materials from alternate wells of said first plurality of wells to create an outer zone of high fluid mobility around said first plurality of wells;

(g) extending a second plurality of wells in fluid communication with said formation laterally and radially outward from said chamber into said formation, said second plurality of wells being substantially shorter than said first plurality of wells and spaced between said first plurality of wells;

(g) injecting said heated or heat-generating fluid into said high mobility zone via said first plurality of wells to sweep fluidized carbonaceous materials from said formation to said second plurality of wells; and (i) recovering fluidized carbonaceous materials from said second plurality of wells.

9. The method of claim 8 wherein said heated or heat-generating fluid is steam.

10. The method of claim 9 wherein steam is injected in step (c) at a pressure above formation fracture pressure.

11. A method for recovering viscous hydrocarbons from a subterranean deposit penetrated by an access shaft which comprises:

(a) drilling a first plurality of substantially horizontal, radially-spaced wells from said shaft into said deposit;

(b) completing said first plurality of wells so that each well is in fluid communication with said deposit over substantially its entire length;

(c) injecting a heated or heat-generating fluid into said deposit via said first plurality of wells to heat said viscous hydrocarbons, and thereafter producing via said first plurality of wells mobilized fluids, including heated viscous hydrocarbons, from said deposit;

(d) recompleting said first plurality of wells so that each recompleted well is in fluid communication with said deposit over less than a majority of its length;

(e) injecting said heated or heat-generating fluid into said deposit and producing heated fluids from said deposit via alternate recompleted wells so that a path of thermal communication is established between said recompleted wells;

(f) drilling a second plurality of substantially horizontal wells from said shaft into said deposit, each of said second plurality of wells being radially spaced between alternate recompleted wells and being substantially shorter than any of said recompleted wells;

(g) completing said second plurality of wells so that each is in fluid communication over an outer portion of its length; and (h) injecting said heated or heat-generating fluid into said first plurality of wells to drive mobilized fluids in said deposit, including heated viscous hydrocarbons, to said second plurality of wells for recovery.

12. The method of claim 11 wherein said first and second pluralities of wells are completed in steps (b), (d), and (g) such that the region of said deposit which surrounds the lower portion of said access shaft from which said wells are drilled remains relatively cool.

13. The method of claim 11 wherein said heated or heat-generating fluid is steam.

14. The method of claim 11 wherein steam is injected in step (c) at a pressure above formation fracture pressure.

15. The method of claim 11 which includes performing step (f) along with performing step (a) and preventing said second plurality of wells from being in fluid communication with said deposit until step (g) is reached.

16. The method of claim 11 which further includes:

(i) recompleting said second plurality of wells such that fluid communication with said deposit is prevented where communication was previously permitted by the completion of step (g) and such that fluid communication with said deposit is permitted where previously prevented; and (j) producing heated fluids from said deposit via said second plurality of recompleted wells.

17. The method of claim 11 wherein each of said second plurality of wells is from about 35 feet to about 200 feet long, said outer portion is from about 10 feet to about 150 feet long, and the length of said first plurality of wells ranges from about 500 to about 2000 feet.

18. The method of claim 11 wherein each of said first plurality of wells is recompleted in step (d) so as to be in fluid communication with said formation over about 5 to about 40 percent of its length.

19. A system of wells for use in the in-situ recovery of mineral values from a subterranean formation comprising:

(a) an access shaft penetrating said formation;

(b) a first array of long, radially-spaced horizontal wells extending outwardly from said shaft into said formation;

(c) means for completing said first array of wells such that each well is in fluid communication with said formation only over an outer portion thereof, whereby a zone of high fluid mobility is created between said outer portions upon injection of a mobilizing fluid into and recovery of mineral values from said formation via alternate wells of said first array;

(d) a second array of horizontal wells radially spaced uniformly between said first array of wells, said second array of wells being substantially shorter than said first array of wells;

(e) means for completing said second array of wells such that each is in fluid communication with said formation, whereby a substantial portion of the mineral values contained between said high mobility zone and said second array of wells are swept to said second array of wells upon injection of said mobilizing fluid into said formation via said first array of wells.

20. The system of claim 19 wherein each of said first array of wells ranges from about 500 to about 2000 feet long and each of said second array of wells ranged from about 35 feet to about 200 feet long.

21. The system of claim 19 wherein each of said first array of wells is in fluid communication with said formation over about 5 to about 40 percent of its length.

* * * * *